US006244842B1

(12) United States Patent
Tieben

(10) Patent No.: US 6,244,842 B1
(45) Date of Patent: Jun. 12, 2001

(54) PUMP

(76) Inventor: James B. Tieben, W. Highway 56, Dodge City, KS (US) 67801

( * ) Notice: Subject to any disclaimer, the term of this patent is extended or adjusted under 35 U.S.C. 154(b) by 0 days.

(21) Appl. No.: 09/436,413

(22) Filed: Nov. 9, 1999

(51) Int. Cl.[7] ..... F01C 19/00

(52) U.S. Cl. ..... 418/104; 418/206.1; 418/182; 418/203; 418/270; 464/162; 403/359.1

(58) Field of Search ..... 418/104, 206.1, 418/182, 203, 270; 464/162; 403/359.1

(56) References Cited

U.S. PATENT DOCUMENTS

| | | | | |
|---|---|---|---|---|
| 2,587,838 | * | 3/1952 | Green | 403/359.1 |
| 3,895,546 | * | 7/1975 | Yamaguchi et al. | 74/695 |
| 3,990,550 | * | 11/1976 | Recker | 403/359.1 |
| 4,009,973 | * | 3/1977 | Heinrich | 418/104 |
| 4,128,022 | * | 12/1978 | Ritter | 74/694 |
| 4,186,618 | * | 2/1980 | Richards | 74/339 |
| 4,195,718 | * | 4/1980 | Schmohe | 403/11 |
| 4,402,654 | * | 9/1983 | Dworak | 418/206.1 |
| 4,595,349 | * | 6/1986 | Preston et al. | 418/206.1 |
| 5,453,651 | * | 9/1995 | Kroner et al. | 464/162 |
| 5,496,155 | * | 3/1996 | Noah et al. | 418/109 |
| 5,772,520 | * | 6/1998 | Nicholas et al. | 464/162 |
| 5,916,139 | | 6/1999 | Tieben . | |
| 5,957,677 | * | 9/1999 | Hill et al. | 418/206.1 |
| 6,179,595 | * | 1/2001 | Buchmuller | 418/104 |

FOREIGN PATENT DOCUMENTS

| | | | | |
|---|---|---|---|---|
| 3-130593 | * | 6/1991 | (JP) | 418/104 |

* cited by examiner

*Primary Examiner*—Thomas Denion
*Assistant Examiner*—Theresa Trieu
(74) *Attorney, Agent, or Firm*—Brinks Hofer Gilson & Lione

(57) ABSTRACT

A hydraulic pump includes a pump mechanism having a driven shaft. The driven shaft is connected to an input shaft by a flexible coupling such as a splined connection. A housing extends completely around the driven shaft, and a high-pressure seal is disposed between the housing and the input shaft. A thrust bearing carries hydraulic axial forces on the input shaft to the housing. This arrangement provides balanced hydraulic forces on both ends of the driven shaft, thereby reducing friction and wear.

18 Claims, 3 Drawing Sheets

PUMP

BACKGROUND

The present invention relates to a pump such as a hydraulic pump, and particularly to a pump that maintains balanced axial forces on the pumping mechanism, even in the event of high inlet and outlet pump pressures.

The hydraulic system disclosed in Tieben U.S. Pat. No. 5,916,139 includes a pump, an actuator and a reservoir. In one mode of operation, the pump inlet is connected to the reservoir and the pump outlet is connected to the actuator. In another mode of operation, the pump inlet is connected to the actuator and the pump outlet is connected to the reservoir. This system encounters relatively high fluid pressures at both the pump inlet and the pump outlet. As explained in the Tieben patent, such pressures can result in undesired axial loads on the pumping mechanism, due to the high internal pressure of the pump. The pump disclosed in the Tieben patent overcomes this potential problem by providing high-pressure seals at both ends of the driven shaft of the pump. In this way, hydraulic axial forces on the driven shaft are balanced, and friction and associated wear are reduced.

One potential drawback of the pump illustrated in the Tieben patent is that two high-pressure shaft seals are required. Furthermore, under some conditions cup seals of the type illustrated in the Tieben patent can cause wear on the sealed shaft and associated leaks.

The present invention is directed to an improved pump that is well-suited for use in applications having high internal pump pressures and that overcomes the potential disadvantages described above.

SUMMARY

By way of introduction, the preferred embodiment described below includes a pump mechanism having a driven shaft. The driven shaft is connected to an input shaft of the pump via a flexible coupling such as a splined coupling. A housing is disposed around the driven shaft, and this housing supports both the driven shaft and the input shaft for rotation. A high-pressure seal such as a mechanical seal is disposed between the housing and the input shaft, and a thrust bearing is disposed between the housing and the input shaft. The flexible coupling transmits fluid pressure within the housing to the outer end of the driven shaft. In this way, fluid pressure on the outer end of the driven shaft tends to balance fluid pressure on the inner end of the driven shaft, thereby reducing or eliminating asymmetrical axial loads.

The foregoing paragraph has been provided by way of introduction, and is not intended to limit the scope of this invention.

DETAILED DESCRIPTION OF THE PRESENTLY PREFERRED EMBODIMENTS

Figure 1:
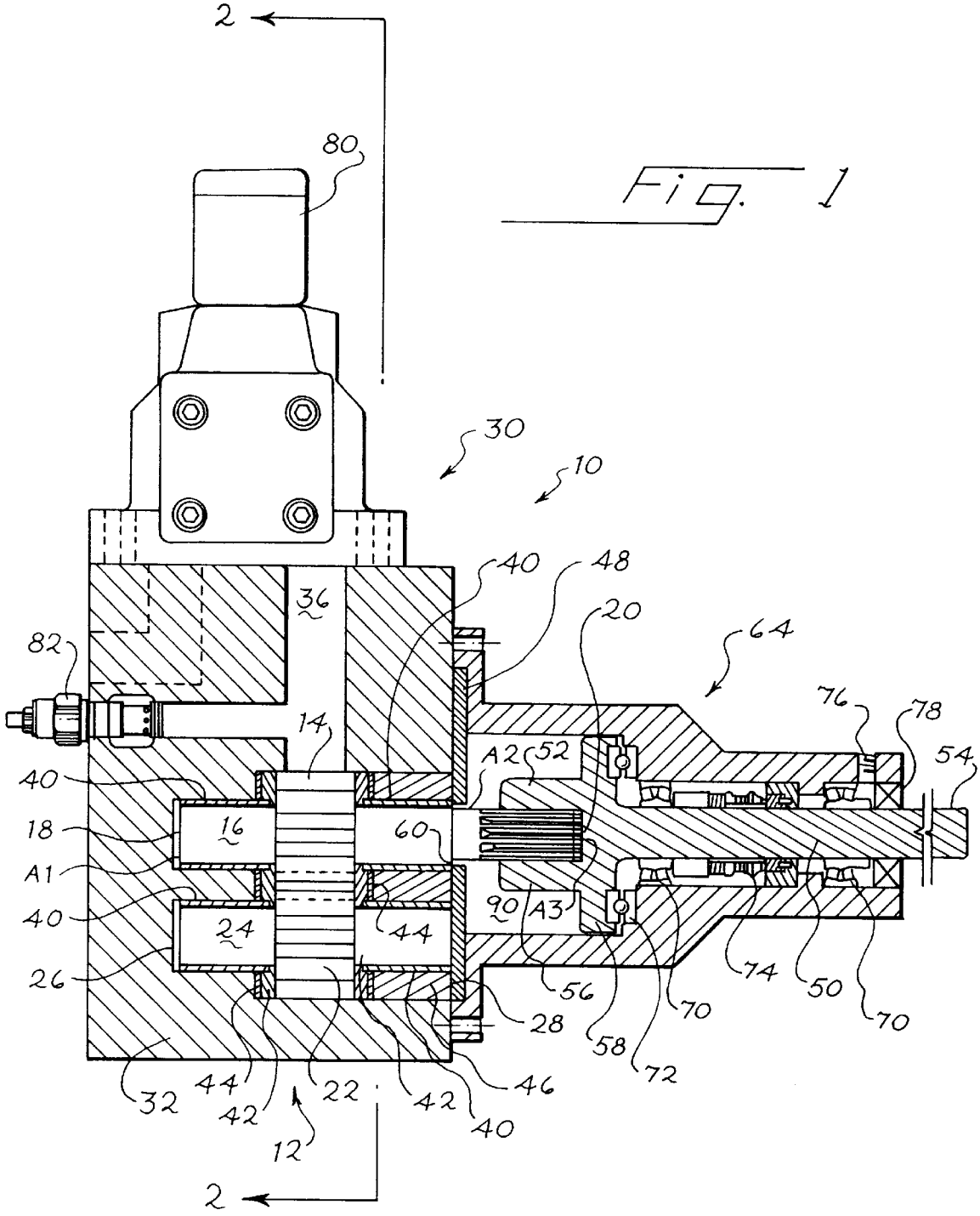
FIG. 1 is a cross-sectional view of a pump that incorporates a preferred embodiment of this invention.
Figure 2:
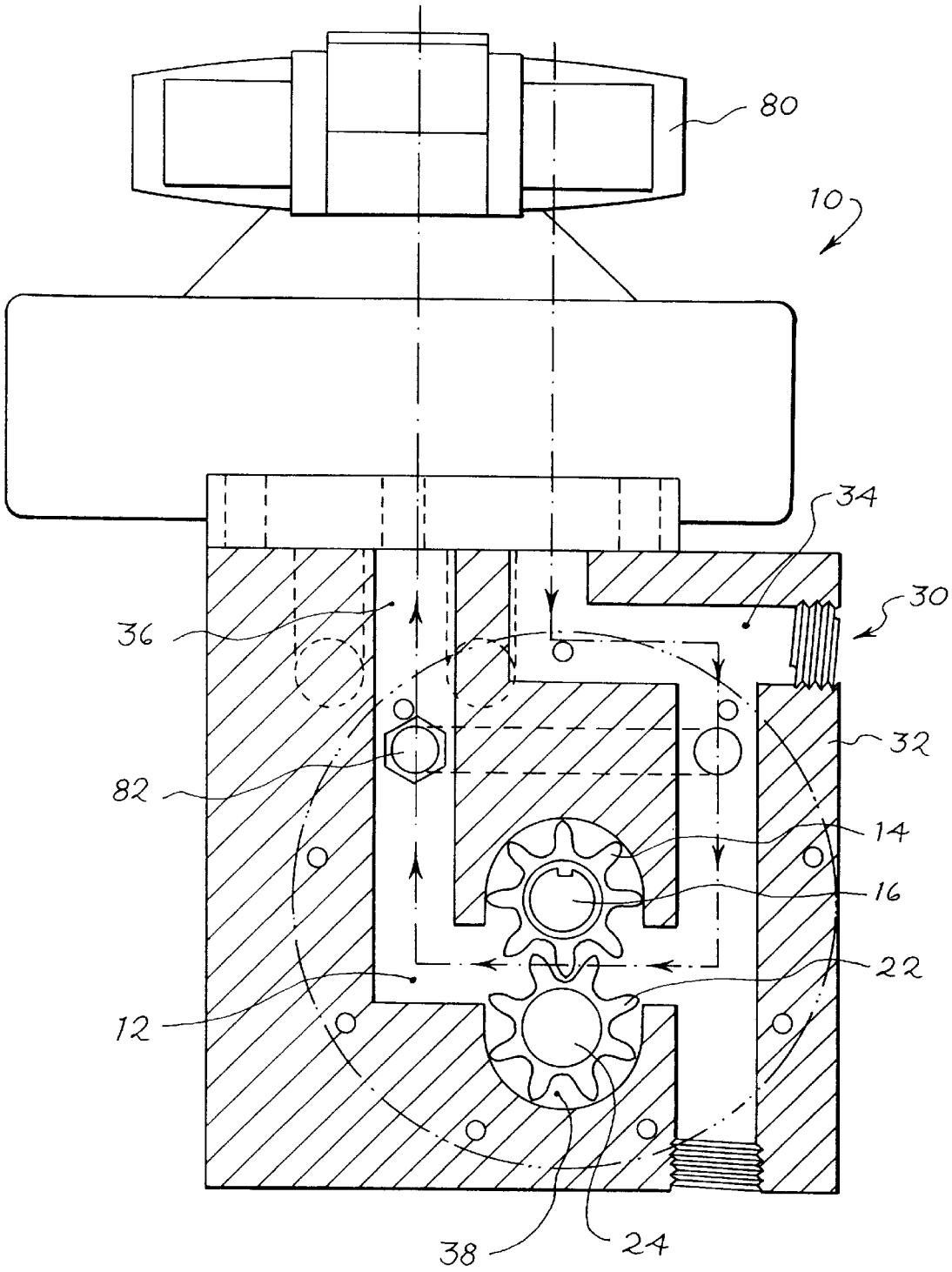
FIG. 2 is a cross-sectional view taken along line 2—2 of FIG. 1.

Turning now to the drawings, FIGS. 1 and 2 show respective cross-sectional views of a pump 10 that includes a pump mechanism 12. In this embodiment, the pump mechanism 12 includes a gear set comprising a driven gear 14 mounted on a driven gear shaft 16 having an inner end 18 and an outer end 20. The driven gear 14 is in meshing engagement with a follower gear 22 that is mounted on a follower gear shaft 24 having an inner end 26 and an outer end 28.

As best shown in FIG. 2, the pump 10 includes a housing 30 having a first portion 32 that defines an inlet passage 34 and an outlet passage 36 in fluid communication with a gear chamber 38. The gears 14, 22 are mounted for rotation in the gear chamber 38 by means of bushings 40 that receive and position the shafts 16, 24 (FIG. 1). The bushings 40 are held in place by wear plates 42 positioned adjacent to inner retainer plates 44. Also provided is an insert 46 that is held in place by an outer retainer plate 48.

The inner retainer plates 44 and the wear plates 42 are conventionally used in gear pumps, and are well known to those skilled in the art. The wear plates 42 may for example be formed of brass, and the inner retainer plates 44 may be formed of steel.

As shown in FIG. 1, the pump 10 also includes an input shaft 50 having an inner end 52 and an outer end 54. The inner end 52 forms a hub 56, and the hub 56 supports a radially extending flange 58.

In this embodiment, the outer end 20 of the driven gear shaft 16 defines a first splined surface, and the hub 56 defines a second splined surface shaped to receive and mesh with the first splined surface. The splined surfaces of the driven gear shaft 16 and the input shaft 50 form a flexible coupling between the two shafts. Though not required, in this embodiment the driven gear shaft 16 forms a shoulder 60 between the driven gear 14 and the outer end 20.

The housing 30 also includes a second portion 64 that supports the input shaft 50 for rotation. Radial bearings 70 are mounted between the input shaft 50 and the second portion 64 of the housing 30. A thrust bearing 72 is mounted between the flange 58 and the second portion 64 of the housing 30. Also, a high pressure seal such as a mechanical seal 74 is mounted between the input shaft 50 and the second portion 64 of the housing 30.

Figure 3:
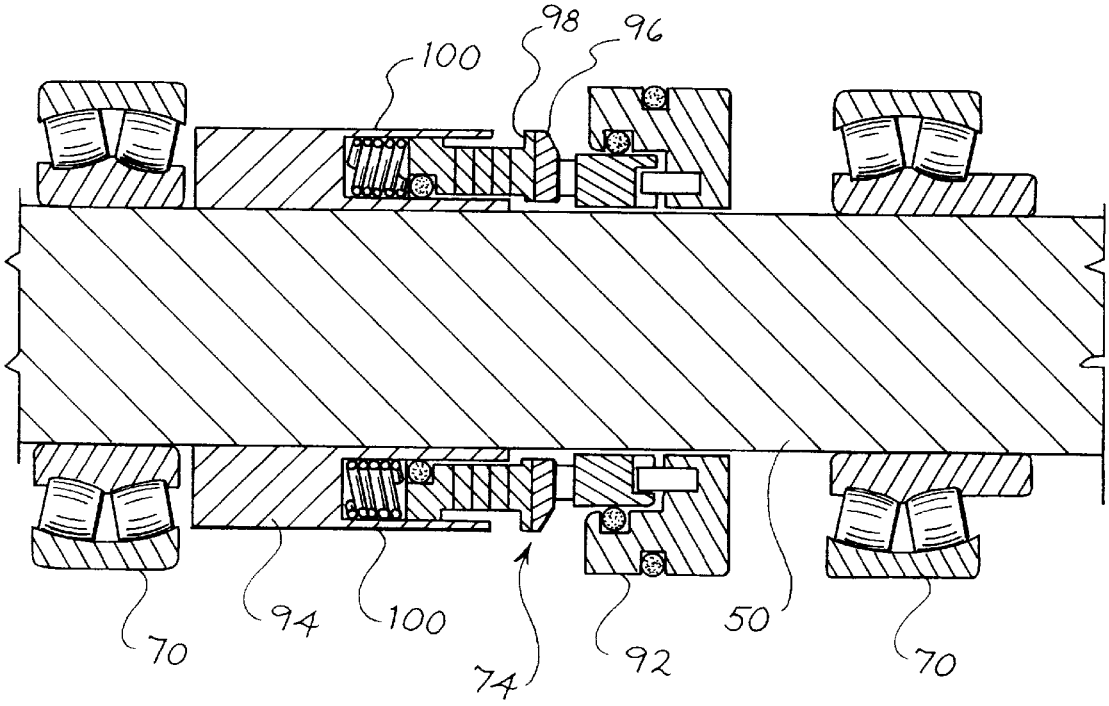
FIG. 3 is an enlarged view of portions of the input shaft, the mechanical seal, and the thrust bearings of FIG. 1.

FIG. 3 provides an enlarged view of the mechanical seal 74 of FIG. 1. The seal 74 includes a retainer 92 sealed to the second portion 64 of the housing 30 (not shown in FIG. 3), and the retainer 92 holds a first annular sealing element 96 that extends around the input shaft 50. The seal 74 also includes a second retainer 94 sealed to the input shaft 50, and the second retainer 94 holds a second annular sealing element 98 in sliding, sealing contact with the first sealing element 96 by means of springs 100. Mechanical seals such as the seal 74 are well known to those skilled in the art. A suitable seal can be obtained from John Crane Co. (Kansas City, Mo.).

A lip seal 78 is mounted between the input shaft 50 and the second portion 64 of the housing 30, and a weep hole 76 is formed in the second portion 64 between the mechanical seal 74 and the lip seal 78 (FIG. 1).

The specific embodiment shown in the drawings also includes a direction control valve 80 that performs the function of the valve 16 of the above-identified Tieben patent, and a bypass valve 82 that performs the function of the valve 24 of the above-identified Tieben patent. Though useful in some applications, the direction control valve 80 and the bypass valve 82 are not essential aspects of this invention.

The housing 30 defines a chamber 90 in which the hub 56 rotates. Fluid pressure in the chamber 90 is substantially equal to fluid pressure in other portions of the pump, as for example adjacent the inner ends 18, 26 of the shafts 16, 24. The flexible coupling comprising the splined surfaces of the driven gear shaft 16 and the input shaft 50 forms a relatively loose connection that ensures that the hydraulic pressure in the chamber 90 is transmitted to the extreme end surface of the driven gear shaft 16.

In the example of FIG. 1, the reference symbol $A_1$ is used for the area of the inner end 18 of the driven gear shaft 16. The area $A_1$ is also equal to the area of the inner end 26 and to the area of the outer end 28 of the follower gear shaft 24. The reference symbol $A_2$ is used for the area of the shoulder 60, and the symbol $A_3$ is used for the area of the outer end 20 of the driven gear shaft 16. In all cases, area is measured in a plane transverse to the longitudinal axis of the respective shafts.

It should be understood that the area $A_1$ is equal to the sum of the area $A_2$ and the area $A_3$. Since all of the areas, $A_1$, $A_2$, $A_3$, are subjected to substantially the same hydraulic pressure within the pump 10, axial hydraulic forces on the driven shaft 16 are substantially balanced and axial forces on the follower shaft 24 are substantially balanced. Axial hydraulic forces on the input shaft 50 are carried by the thrust bearing 72 in a manner that substantially reduces wear and friction. Because the splined connection between the driven shaft 16 and the input shaft 50 allows axial as well as limited radial movement therebetween, the driven gear shaft 16 and the driven gear 14 are free to float in the housing 30 in a way that minimizes wear and friction. Since both of the ends of the driven gear shaft 16 and both of the ends of the follower gear shaft 24 are situated within the housing and subjected to the internal hydraulic pressure of the pump, axial forces on these shafts are balanced and wear and friction are minimized.

One significant advantage of the pump 10 is that it operates efficiently and reliably even when subjected to a high pressure at the inlet passage 34. For example, the pump 10 can be used in the hydraulic system described in Tieben U.S. Pat. No. 5,916,139. In this system, pressure in the reservoir is selectively applied to the pump inlet to substantially reduce the power needed to drive the pump. In conventional pumps, high inlet pressure can result in undesired axial loads on the pumping mechanism, due to the high internal pressure of the pump. The pump 10 overcomes this problem by balancing axial forces on the gear shafts as described above. The pump 10 is well-suited for use in a wide variety of applications, and it is not limited to the specific applications described above.

Of course, it should be understood that many changes and modifications can be made to the preferred embodiment described above. This invention is not limited to use with gear pumps, but can be applied to other types of pumps, including pumps using vane-type or piston-type pumping mechanisms.

The splined connection between the input shaft 50 and the driven shaft 16 is only one example of a flexible coupling. Other flexible couplings can be used, including for example chain couplers and flexible couplings known under the trade names Browning, Para-flex and Lovejoy.

The thrust bearing 72 shown in the drawings is only one example of a thrust bearing, and other thrust bearings can be substituted. For example, roller bearings can be used instead of ball bearings, or bushing-type thrust bearings can be used. Also, the thrust bearing can be formed as part of a radial bearing. The thrust bearing can be positioned at other places along the input shaft than the position shown in the drawings. For example, the thrust bearing can be combined with a radial bearing and positioned at any desired point along the input shaft. Similarly, ball bearings, bushing-type radial bearings or other types of roller bearings may be substituted for the illustrated radial bearings.

The mechanical seal 74 may be replaced with other types of high pressure seals, including cup seals, for example. As used herein, the use of the term "high pressure seal" is intended to refer to a seal capable of sealing hydraulic fluid pressurized to a pressure of at least 500 psi.

The housing 30 is shown in the preferred embodiment as including two separate portions held together by threaded fasteners. Of course, it should be recognized that the first and second portions of the housing can be defined by a single integrated structure rather than the separable structure shown. When separable elements are used, the junction between the first and second portions of the housing can be placed at any desired point to facilitate fabrication and assembly.

The foregoing detailed description has described only a few of the many forms that this invention can take. For this reason, this detailed description is intended by way of illustration and not by way of limitation. It is only the following claims, including all equivalents, that are intended to define the scope of this invention.

What is claimed is:

1. A pump comprising:

a pump mechanism comprising a driven shaft comprising an inner end and an outer end;

an input shaft comprising an inner end and an outer end;

a flexible coupling coupled between the inner end of the input shaft and the outer end of the driven shaft;

a housing disposed around the flexible coupling, the outer end of the drive shaft, and the inner end of the input shaft;

a seal disposed between the housing and the input shaft; and a thrust bearing disposed between the housing and the input shaft;

said flexible coupling transmitting fluid pressure within the housing to the outer end of the driven shaft whereby fluid pressure on the outer end of the driven shaft balancing fluid pressure on the inner end of the driven shaft.

2. The invention of claim 1 wherein the pump mechanism comprises a driven gear mounted on the driven shaft and a follower gear mounted on a follower gear shaft, said driven gear meshing with the follower gear to provide a gear-pumping action.

3. The invention of claim 1 wherein the flexible coupling comprises a first splined surface on the outer end of the driven shaft and a second splined surface on the inner end of the input shaft and engaged with the first splined surface.

4. The invention of claim 3 wherein the first splined surface is shaped to fit within and to be received by the second splined surface.

5. The invention of claim 4 wherein the inner end of the input shaft comprises a hub, wherein the hub comprises the second splined surface, and wherein the thrust bearing is positioned between the hub and the housing.

6. The invention of claim 1 wherein both the inner end and the outer end of the driven shaft are disposed within the housing and are subjected to internal hydraulic pressure of the pump contained by the housing.

7. The invention of claim 1 wherein the seal comprises a mechanical seal.

8. A pump comprising:

a gear pump set comprising a driven gear mounted on a driven gear shaft and a follower gear mounted on a follower gear shaft, said driven gear shaft comprising an inner end and a splined outer end, said follower gear shaft comprising an inner end and an outer end;

an input shaft comprising a splined inner end engaged with the splined outer end of the driven gear shaft;

a housing comprising a first portion that supports the gear shafts for rotation and a second portion that supports the input shaft for rotation;

a high pressure seal disposed between the housing and the input shaft;

a thrust bearing disposed between the housing and the input shaft;

the first and second ends of the driven gear shaft and the first and second ends of the follower gear shaft all disposed within the housing and all subjected to internal hydraulic pressure of the pump contained by the housing.

9. The invention of claim 8 wherein the seal comprises a mechanical seal.

10. A pump comprising:

a pump mechanism comprising a driven shaft comprising an inner end and an outer end;

an input shaft comprising an inner end and an outer end;

a coupling coupled between the inner end of the input shaft and the outer end of the driven shaft;

a housing disposed around the coupling, the outer end of the drive shaft, and the inner end of the input shaft;

said coupling transmitting fluid pressure generated by the pump mechanism to the outer end of the driven shaft, whereby fluid pressure on the outer end of the driven shaft and fluid pressure on the inner end of the driven shaft create respective axial hydraulic forces on the input shaft, thereby reducing asymmetrical axial loads on the driven shaft.

11. The invention of claim 10 wherein the fluid pressure on the outer end of the driven shaft and the fluid pressure on the inner end of the driven shaft create substantially balanced axial hydraulic forces on the driven shaft.

12. The invention of claim 10 wherein the coupling comprises a splined coupling.

13. The invention of claim 10 further comprising a seal disposed between the housing and the input shaft.

14. The invention of claim 13 wherein the seal comprises a mechanical seal.

15. The invention of claim 13 further comprising a thrust bearing disposed between the housing and the input shaft.

16. The invention of claim 14 wherein the inner end of the input shaft comprises a hub, wherein the hub comprises a splined surface, and wherein the thrust bearing is positioned between the hub and the housing.

17. The invention of claim 10 wherein the pump mechanism comprises a driven gear mounted on the driven shaft and a follower gear mounted on a follower gear shaft, said driven gear meshing with the follower gear to provide a gear-pumping action.

18. The invention of claim 10 wherein both the inner end and the outer end of the driven shaft are disposed within the housing and are subjected to internal hydraulic pressure of the pump contained by the housing.

* * * * *

UNITED STATES PATENT AND TRADEMARK OFFICE

CERTIFICATE OF CORRECTION

PATENT NO. : 6,244,842 B1
APPLICATION NO. : 09/436413
DATED : June 12, 2001
INVENTOR(S) : James B. Tieben It is certified that error appears in the above-identified patent and that said Letters Patent is hereby corrected as shown below:

In the Claims

In claim 1, line 17, delete "balancing" and substitute --substantially balances-- in its place.

Signed and Sealed this

Thirty-first Day of July, 2007

JON W. DUDAS
*Director of the United States Patent and Trademark Office*